United States Patent [19]

Anderson

[11] 4,326,341

[45] Apr. 27, 1982

[54] DRYING METHOD AND APPARATUS FOR DRYING PRUNES, FISH, BREWERS GRAIN, SHELLED CORN, AND THE LIKE

[76] Inventor: Max F. Anderson, Stewardson, Ill. 62463

[21] Appl. No.: 185,166

[22] Filed: Sep. 8, 1980

[51] Int. Cl.[3] ..... F26B 5/04

[52] U.S. Cl. ..... 34/27; 34/32; 34/73; 34/15; 34/92; 99/472; 99/483; 426/465

[58] Field of Search ..... 426/443, 456, 465; 99/467, 472, 483; 417/92; 34/92, 73, 75, 27, 32, 15

[56] References Cited

U.S. PATENT DOCUMENTS

| | | | |
|---|---|---|---|
| 1,427,656 | 8/1922 | Tibbets | 417/92 |
| 2,505,198 | 4/1950 | Moskowitz et al. | 417/92 |
| 3,132,929 | 5/1964 | Thuse | 34/92 |

*Primary Examiner*—Larry I. Schwartz
*Attorney, Agent, or Firm*—Victor R. Beckman

[57] ABSTRACT

Method and apparatus for drying moisture-containing material by use of a vacuum tank as disclosed. The tank is partially filled with cold liquid, such as water, and the material to be dried is supported in the tank above the liquid surface. Surface condensing means are located inside the tank adjacent the tank bottom in the cold liquid which condensing means has a combined vapor inlet-liquid overflow conduit through which vapor which evaporates from the material to be dried enters and through which liquid in the tank may overflow. Condensate and liquid overflow are removed from the condensing means as by pumping means. Air is evacuated from the tank as by first filling the tank with liquid while venting air therefrom, then pumping liquid from the tank through said condensing means. Moisture which rapidly evaporates from the material to be dried is condensed at the surface of the cold liquid and in said condensing means, for removal thereof by pumping through the outlet therefrom.

11 Claims, 2 Drawing Figures

DRYING METHOD AND APPARATUS FOR DRYING PRUNES, FISH, BREWERS GRAIN, SHELLED CORN, AND THE LIKE

BACKGROUND OF THE INVENTION

Dryers for drying food products, or the like, often require a large expenditure of energy in the operation thereof, particularly where heating means are primarily relied upon for the extraction of moisture from the material to be dried. Also, many drying methods rely upon the use of blowers, or the like, for the removal of moisture-laden air from around the material being dried. However, none make use of a vacuum tank partially filled with cold liquid and provided with a heat exchanger within the cold liquid for condensing vapor which rapidly escapes from the material being dried when the tank pressure is reduced below atmospheric pressure.

SUMMARY OF THE INVENTION AND OBJECTS

An object of this invention is the provision of improved method and apparatus for drying material under subatmospheric conditions, which are well adapted for drying food products such as prunes, raisins, fish, brewers grain, shelled corn and the like.

An object of this invention is the provision of method and apparatus of the above-mentioned type which includes the use of cold liquid in the bottom of a vacuum tank for use in condensing vapor which escapes from material to be dried loaded in the tank above the surface of the liquid.

An object of this invention is the provision of method and apparatus of the above-mentioned type which does not necessarily require fuel for heating of the material to be dried.

The above and other objects and advantages of this invention are achieved by use of a fluid-tight vacuum tank, or container, into which the material to be dried is loaded above the surface of cold liquid, such as water, which partially fills the tank. To provide the tank with the cold water, the tank may be substantially completely filled with water while air is vented therefrom, for the removal of air therefrom. Then, the vent is closed and a portion of the water is removed from the tank, as by pumping, or the creation of a partial vacuum therein and the rapid evaporation, and cooling, of water which remains in the tank. The tank then is opened and the material to be dried is loaded therein above the surface of the water. Now, with the tank again closed, the pressure inside the tank, above the liquid surface, is again reduced as by repeating the above-described filling of the tank with water and partial removal of water therefrom. Now, under the low pressure condition, moisture rapidly evaporates from the material to be dried. A surface condenser is located inside the tank beneath the surface of the water therein, which condenser has an inlet in communication with the space above the cold water surface for passage of vapor from the material into the condenser. The condensor inlet also functions as a liquid overflow for limiting the level of the water in the tank. Vapor which condenses on the surface of the cold water passes through the condensor inlet-overflow conduit into the condensor. Liquid is pumped from condenser for the removal of condensate from the apparatus. If desired, heating means may be located adjacent the material to be dried to promote the evaporation of liquid therefrom during the drying process.

The invention, together with other objects and advantages thereof will be better understood from the following detailed description considered with the accompanying drawings.

BRIEF DESCRIPTION OF THE DRAWINGS

In the drawings, wherein like reference characters refer to the same parts in the several views:

Referring to the drawings, the novel drying apparatus embodying the invention disclosed therein is shown to comprise a fluid-tight vacuum tank, or container, 10 formed with a bottom 12, top 14, and upright side walls 16 extending between said top and bottom members, within which tank the material to be dried may be loaded. In FIG. 1, a box, or container, 18 holding material 20 to be dried is shown inside the vacuum tank, which box is formed with openings 22 in at least the bottom thereof through which water may drain and vapor may circulate. Supporting means 24 for the support of the material are provided which, for purposes of illustration, are shown comprising a perforated floor attached to the upright walls of the tank intermediate the bottom and top walls. The perforated floor is adapted for the support of the material to be dried while allowing for the free flow of fluid therethrough.

Figure 2:
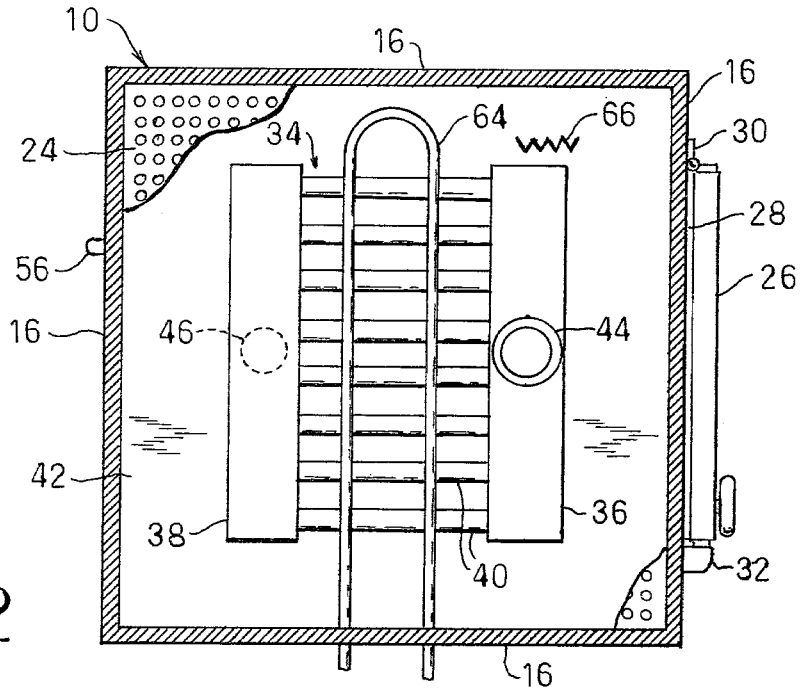
FIG. 2 is a generally diagrammatic sectional view taken substantially along line 2—2 of FIG. 1, but showing a portion of a perforated floor broken away.

The illustrated drying apparatus includes a door 26 at one of the side walls 16 to facilitate loading and unloading the tank 10 with the material to be dried. A seal member 28 adjacent the periphery of the door provides a fluid-tight engagement between the door and tank in the door-closed condition. The door is shown pivotally attached to the tank by hinge means 30, and a suitable manually operated latch mechanism 32 releasably holds the door in the illustrated closed position.

Vapor condensing means 34, in the form of a surface condenser, is located adjacent the bottom of the vacuum tank 10 beneath the floor 24. For purposes of illustration, the condenser is shown to comprise inlet and outlet manifolds 36 and 38, respectively, between which a plurality of tubes 40 extend. The condenser 34 is located within cold liquid 42, such as water, which partially fills the tank 10 during the drying process. During drying, the water level is below the material to be dried, here, beneath the floor 24 which supports such material 20. An upwardly extending combination overflow and vapor inlet passage, or conduit, 44 provides communication between the inlet manifold 36 of the condenser and the region 45 above the surface of the water 42 for passage of vapor to be condensed into the condenser. It also functions as an overflow tube for establishing the upper-most water level in the tank during the drying process.

The condenser outlet manifold 38 is connected to a downwardly extending pipe, or conduit, 46 extending through the bottom 12 of the tank. Condensate and overflow from the condenser 34 is pumped from the discharge tube 46 by use of a pump 48. In the illustrated arrangement, the pump is of the reversible type for pumping liquid in either direction through the tube 46. A two-way valve 50 connects the other pump opening to a water source, or to a drain or reservoir, depending upon the position of the valve. With the pump connected to the drain, the pump may be operated in one direction for removal of liquid, including condensate, from the condensor 34. In the other valve position, water may be supplied to the vacuum tank 10 through the condenser 34 by operation of the pump 48 in the opposite pumping direction. If a pressurized water source is available, water may be supplied to the tank through line 52 and shut-off valve 54 in the line. In this case, the pump 48 is used only for pumping liquid from the tank, and not into the tank.

Figure 1:
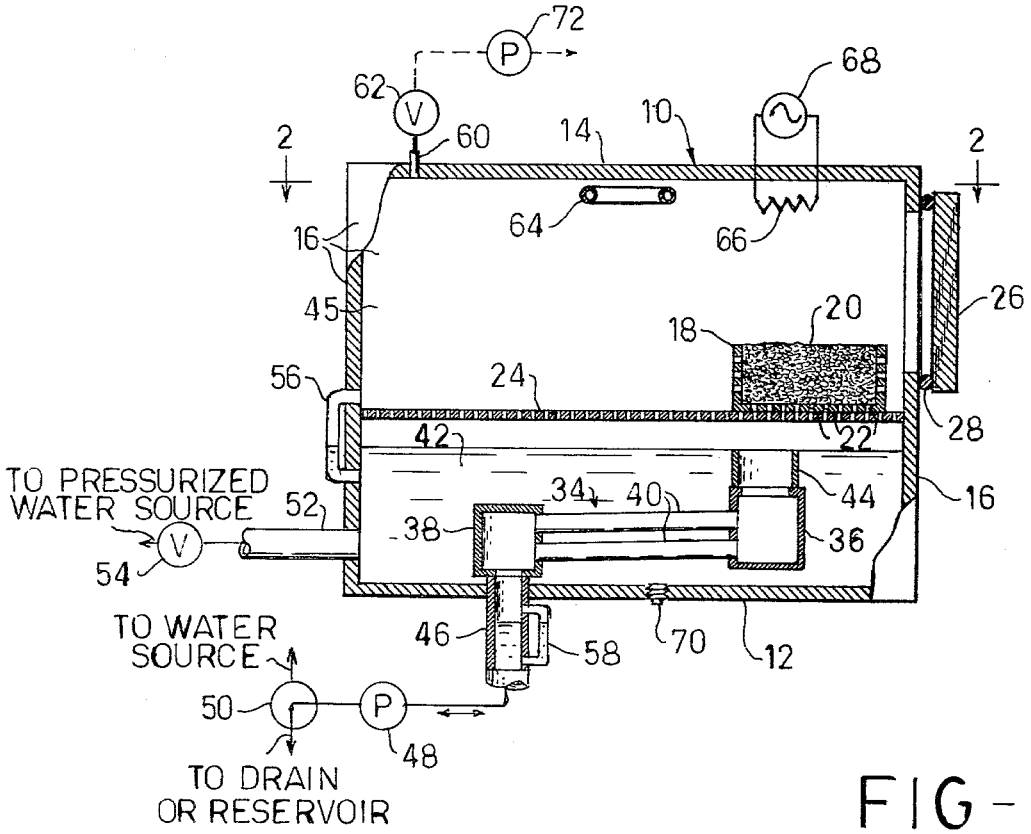
FIG. 1 is a generally diagrammatic side elevational view of a novel drying apparatus embodying the present invention, with parts shown broken away for clarity.

Liquid level gauges 56 and 58 at the tank 10 and discharge tube 46 provide the operator with an indication of the water level in the tank 10 and in the discharge tube 46, respectively. A vent 60, with a valve 62 for opening and closing the same, is provided at the top of the tank for use in venting air from the tank in a manner described below. If desired, or required, heating means may be provided for heating the material 20 to be dried to facilitate the evaporation of liquid therefrom. Any suitable heating means such as hot water or steam, electric, solar, or the like, may be used. In FIGS. 1 and 2, one such heating means is shown comprising a loop of pipe 64 through which hot fluid is circulated from any desired source, not shown, for heating the material 20 to be dried. Another heating means comprising a resistance heating element 66 connected to a power source 68 is shown in FIG. 1, which heating means serves the same function as heating means 64. As noted above, such heating means simply are illustrative of types of heating means which may be employed with this invention.

The system is operated in a cyclical manner, now to be described. To provide for rapid condensation of vapor contained in the region 45, the condenser cooling water 42 first is cooled to a low temperature, well below ambient temperature. One such means for lowering the water temperature includes subjecting the region 45 above the water to a low pressure to promote rapid evaporation of water from the surface and, consequently, cooling the water. Any suitable means for producing a vacuum may be employed. For example, with the door 26 closed and vent valve 62 opened, water may be entered into the tank 10, filling the same. As described above, water may be pumped into the tank from a suitable source through valve 50 using pumps 48, in which case water enters the tank through the condenser 34. Alternatively, water under pressure simply may be fed into the tank through the valve 54 and line 52. As water enters the tank, air is forced out through the vent 60. When the tank is completely filled with water, the valve 62 is closed and the water source is cut-off. Valve 50 then is operated for connection of the pump 48 to a drain, or reservoir, and the pump is operated for pumping water from the tank. As water is pumped from the tank, a vacuum is formed above the water surface whereupon water rapidly evaporates from said surface. Heat for such evaporation is extracted from the water, cooling the same to or about the freezing point.

When pumping water from the tank 10 through the condenser 34, it will be apparent that the level thereof outside the condenser may be reduced only to the illustrated level established by the upper end of the inlet-overflow tube 44 to the condenser. With continued pumping, water is removed from inside of the condenser. As noted above, the gauges 56 and 58 provide the operator with a visual indication of the water level inside the tank 10 and in the condenser exit tube 46, respectively.

When the water 42 has been cooled, say, in the manner above-described, the door 26 is opened and the material to be dried is loaded inside the tank. In FIG. 1, box 18 formed with openings 22 and containing the material 20 to be dried is shown located inside the tank on the perforated floor 24. With the material 20 inside the tank, the door 26 is reclosed, and air again is evacuated from the region 45 above the now-cold liquid 42. The above-described method of air removal may be employed, namely the filling of the now partially filled tank with water while venting air therefrom, and the subsequent removal of water to the illustrated levels using the pump 48 while preventing the entry of air into the tank. The cold water in the bottom of the tank substantially remains thereat while water is pumped from the tank through the condenser 34. The condenser is emptied of water, with some water being left in the drain tube 46 to provide an additional seal between the low pressure tank interior and ambient outside pressure. In the vacuum which is created by the pumping of water from the tank, moisture rapidly evaporates from the material to be dried which vapor condenses on the surface of the cold water 42, and inside the condenser 34 located therein. The resultant rise in the water level overflows into the condenser through the overflow-inlet tube 44. The overflow and condensate flow downwardly into the discharge tube 46, and the pump 48 is operated as required for the removal of condensate therefrom.

Heat may be supplied to the material 20 by use of heating means 64 and/or 66 to promote the evaporation of moisture therefrom. During drying, the temperature of the water 42 in the bottom of the vacuum tank remains substantially less than that of the material being dried which is located above the water surface. When dried to a desired degree, the material is removed from the tank and, if desired, the water may be drained from the bottom of the tank through use of a removable drain plug 70.

The invention having been described in detail in accordance with requirements of the Patent Statutes, various changes and modifications will suggest themselves to those skilled in this art. For example, other means for evacuating air from the region 45 above the surface of the liquid 42 in the tank may be employed. Such air may be evacuated as by use of a vacuum pump, such as pump 72, shown connected to the tank through the vent 60 and an associated valve. Operation of the pump 72 produces a subatmospheric pressure condition within the tank to promote evaporation, and cooling. When the pump 72 is used to reduce the pressure, it will be apparent that there is no requirement to first completely fill the tank with water. Flooding of the material 20 to be dried thereby is avoided. Of course, either method, or both methods, of air evacuation may be employed. Also, the water 42 may be cooled initially by other means. For example, cold water could be introduced into the tank initially, thereby avoiding the requirement to cool the same by evaporation. With cold water already in the tank, material 20 inside the tank is dried by air removal in a manner such as described above. It also will be apparent that suitable moisture sensing means, not shown, may be included for sensing the moisture content of the material inside the vacuum tank. The drying operation then may be terminated, manually or automatically, when such sensing means indicates that the material is sufficiently dry. Also, for bulk loading and unloading, the apparatus may be provided with openings suitably located for loading and unloading by means of chutes, slides, conveyors, or the like. An inclined interior floor also may be included in the construction to promote the flow of dried material from the tank through a suitably positioned door opening. In addition, material to be dried may be cleaned first by flooding the tank with water while allowing water, together with chaff, debris, and the like, contained in the material, to overflow from a suitable opening in the tank. Shelled corn to be dried, for example, often contains much chaff which is readily removed by such washing operation. The tank could be filled with nozzles for directing the wash water onto the material for improved washing action, if desired. It is intended that the above and other changes and modifications shall fall within the spirit and scope of the invention as defined in the appended claims.

I claim:

1. Apparatus for drying material comprising
- a fluid-tight vacuum tank,
- means for supplying liquid to the tank to partially fill the same,
- means for supporting material to be dried inside the tank above the surface of the liquid contained therein,
- a surface condenser inside the tank adjacent the tank bottom within said liquid for condensing vapor evaporated from said material to be dried, and
- means for removing condensate from said surface condenser while preventing the entry of outside air into said tank through said surface condensor.

2. Apparatus for drying material as defined in claim 1 including means for evacuating air from said tank after material to be dried is loaded therein to promote evaporation of moisture from said material.

3. In a method of drying material containing moisture in a vacuum tank, which method includes
- providing cold liquid inside the tank to partially fill the same,
- loading material to be dried inside the tank above the cold liquid surface,
- sealing the tank against fluid leakage,
- evacuating air from the tank for exposure of said material to a subatmospheric pressure and the evaporation of moisture from said material, and
- condensing vapor from the material at a surface condensor located inside the tank within said cold liquid adjacent the bottom of the tank.

4. In a method of drying material as defined in claim 3 including,
- removing condensate from the condenser while preventing the entry of outside air into said tank through said condenser.

5. In a method of drying material as defined in claim 3 wherein said step of evacuating air from the tank includes
- substantially completely filling said tank with liquid while venting air from said tank, and
- pumping liquid from said tank while preventing the reentry of air therein.

6. In a method of drying material containing moisture in a vacuum tank, which method includes
- providing cold liquid inside the tank to partially fill the same,
- loading material to be dried inside the tank above the cold liquid surface,
- sealing the tank against fluid leakage,
- evacuating air from the tank for exposure of said material to a subatmospheric pressure and the evaporation of moisture from said material, and
- condensing vapor from the material at a surface condenser located inside the tank within said cold liquid adjacent the bottom of the tank,
- said step of evacuating air from the tank including
- substantially completely filling said tank with liquid while venting air from said tank, and
- pumping liquid fom said tank through said condenser for partial drainage of the tank and for removal of liquid from said condenser while preventing the reentry of air therein.

7. In a method of drying material as defined in claim 3 wherein said step of evacuating air from the tank includes pumping of air therefrom from above the surface of the cold liquid contained therein.

8. In a method of drying material as defined in claim 3 wherein said liquid comprises water.

9. In a method of drying moisture-containing material in a vacuum tank, which method includes
- providing cold liquid inside the tank to partially fill the tank to the level of the upper end of an overflow conduit therein, which overflow conduit communicates with the outside of the tank through a surface condenser in the cold liquid inside the tank,
- loading material to be dried inside the tank above the liquid surface,
- sealing the tank against fluid leakage,
- evacuating air from the tank for exposure of said material to a subatmospheric pressure and evaporation of moisture from said material loaded therein,
- condensing vapor from the material at the surface of the cold liquid contained in the tank and in the surface condenser located in the cold liquid,
- removing condensate from the tank through said overflow conduit and surface condenser while preventing entry of outside air into the tank.

10. In a method of drying material as defined in claim 9 wherein said cold liquid inside the tank is provided by
- substantially completely filling the tank with water while venting air therefrom, and
- removing water from the tank to the level of the overflow conduit while preventing the passage of air into the tank thereby cooling said water by evaporation.

11. In a method of drying material as defined in claim 10 wherein said water is removed from said tank by pumping.

* * * * *